US012655529B2

(12) United States Patent
Oikawa

(10) Patent No.: US 12,655,529 B2
(45) Date of Patent: Jun. 16, 2026

(54) CARBON DIOXIDE TREATMENT APPARATUS, CARBON DIOXIDE TREATMENT METHOD AND METHOD OF PRODUCING CARBON COMPOUND

(71) Applicant: HONDA MOTOR CO., LTD., Tokyo (JP)

(72) Inventor: Hiroshi Oikawa, Saitama (JP)

(73) Assignee: HONDA MOTOR CO., LTD, Tokyo (JP)

( * ) Notice: Subject to any disclaimer, the term of this patent is extended or adjusted under 35 U.S.C. 154(b) by 565 days.

(21) Appl. No.: 18/172,329

(22) Filed: Feb. 22, 2023

(65) Prior Publication Data

US 2023/0287580 A1 Sep. 14, 2023

(30) Foreign Application Priority Data

Mar. 11, 2022 (JP) ..... 2022-038167

(51) Int. Cl.
*C25B 3/26* (2021.01)
*C25B 1/23* (2021.01)
(Continued)

(52) U.S. Cl.
CPC ..... *C25B 3/26* (2021.01); *C25B 1/23* (2021.01); *C25B 3/03* (2021.01); *C25B 9/15* (2021.01);
(Continued)

(58) Field of Classification Search
CPC ..... C25B 3/26; C25B 15/087
See application file for complete search history.

(56) References Cited

U.S. PATENT DOCUMENTS 4,197,421 A 4/1980 Steinberg
11,904,275 B2 * 2/2024 Oikawa ..... C25B 15/08
(Continued)

FOREIGN PATENT DOCUMENTS

CN 108570690 A 9/2018
CN 113502488 A 10/2021
(Continued)

OTHER PUBLICATIONS

Weng et al, High Voltage Vanadium-Metal Hydride Rechargeable Semi-Flow Battery, Journal of the Electrochemical Society, vol. 160, No. 9, Jun. 2013, p. A1384 (Year: 2013).*
(Continued)

*Primary Examiner* — Harry D Wilkins, III
(74) *Attorney, Agent, or Firm* — CKC & PARTNERS CO., LLC

(57) ABSTRACT

A carbon dioxide treatment apparatus includes: a capturing device that captures carbon dioxide; and an electrochemical reaction unit that electrochemically reduces the carbon dioxide captured by the capturing device, and the electrochemical reaction unit includes a cathode, an anode, an anion exchange membrane provided between the cathode and the anode, a cathode-side liquid flow path which is provided adjacent to the cathode and through which an electrolytic solution flows, an anode-side liquid flow path which is provided adjacent to the anode and through which the electrolytic solution flows and a first liquid supply path which supplies, to the anode-side liquid flow path, the electrolytic solution A which has flowed through the cathode-side liquid flow path.

6 Claims, 3 Drawing Sheets

(51) Int. Cl.

| | |
|---|---|
| ***C25B 3/03*** | (2021.01) |
| ***C25B 9/15*** | (2021.01) |
| ***C25B 9/19*** | (2021.01) |
| ***C25B 15/08*** | (2006.01) |
| *H01M 16/00* | (2006.01) |

(52) U.S. Cl.

CPC ..... *C25B 9/19* (2021.01); *C25B 15/08* (2013.01); *C25B 15/081* (2021.01)

(56) References Cited

U.S. PATENT DOCUMENTS

| | | | | |
|---|---|---|---|---|
| 2004/0166412 | A1 | 8/2004 | Bugnet et al. | |
| 2014/0151240 | A1* | 6/2014 | Bedell | B01D 53/1475 205/462 |
| 2018/0264429 | A1 | 9/2018 | Sugano et al. | |
| 2018/0265440 | A1 | 9/2018 | Kudo et al. | |
| 2018/0274108 | A1 | 9/2018 | Ono et al. | |
| 2019/0233952 | A1 | 8/2019 | Sheehan | |
| 2019/0292668 | A1 | 9/2019 | Fujinuma | |
| 2020/0095692 | A1* | 3/2020 | Fujinuma | C25B 3/29 |
| 2021/0079543 | A1 | 3/2021 | Mikoshiba et al. | |
| 2021/0262104 | A1* | 8/2021 | Trembly | C25B 15/021 |
| 2021/0292925 | A1 | 9/2021 | Mikoshiba et al. | |
| 2022/0118406 | A1 | 4/2022 | Lackner | |
| 2022/0274061 | A1* | 9/2022 | Oikawa | C25B 1/04 |
| 2022/0282384 | A1 | 9/2022 | Shimada et al. | |
| 2022/0282387 | A1 | 9/2022 | Shimada et al. | |
| 2022/0307145 | A1 | 9/2022 | Shimada et al. | |
| 2023/0119993 | A1 | 4/2023 | Oikawa | |
| 2025/0288951 | A1* | 9/2025 | Saito | B01D 53/326 |

FOREIGN PATENT DOCUMENTS

| | | | |
|---|---|---|---|
| DE | 102019219302 | A1 | 6/2021 |
| JP | H04290526 | A | 10/1992 |
| JP | 2001035526 | A | 2/2001 |
| JP | 2004538609 | A | 12/2004 |
| JP | 2018131647 | A | 8/2018 |
| JP | 2018154898 | A | 10/2018 |
| JP | 2019167556 | A | 10/2019 |
| JP | 2019183286 | A | 10/2019 |
| JP | 2019203193 | A | 11/2019 |
| JP | 2020087554 | A | 6/2020 |
| JP | 2020147776 | A | 9/2020 |
| JP | 2022508992 | A | 1/2022 |
| WO | 2018232515 | A1 | 12/2018 |
| WO | 2020067577 | A1 | 4/2020 |
| WO | 2020109295 | A1 | 6/2020 |
| WO | 2022042877 | A1 | 3/2022 |

OTHER PUBLICATIONS

Notification of Reasons for Refusal issued in the JP Patent Application No. 2022-038167, mailed on Jan. 9, 2024.

Office Action issued Apr. 26, 2023 in the U.S. Appl. No. 17/674,935.

Notification of Reasons for Refusal issued Oct. 4, 2022 in the JP Patent Application No. 2021-030950.

Notification of Reasons for Refusal issued Apr. 4, 2023 in the JP Patent Application No. 2021-030950.

Office Action issued Jul. 11, 2023 in the CN Patent Application No. 202210168655.4.

Office Action issued Apr. 29, 2026 in the CN Patent Application No. 202310168926.0.

* cited by examiner

CARBON DIOXIDE TREATMENT APPARATUS, CARBON DIOXIDE TREATMENT METHOD AND METHOD OF PRODUCING CARBON COMPOUND

This application is based on and claims the benefit of priority from Japanese Patent Application No. 2022-038167, filed on 11 Mar. 2022, the content of which is incorporated herein by reference.

BACKGROUND OF THE INVENTION

Field of the Invention

The present invention relates to a carbon dioxide treatment apparatus, a carbon dioxide treatment method and a method of producing a carbon compound.

Related Art

Conventionally, a technology is known which captures carbon dioxide in an exhaust gas or air and electrochemically reduces it to obtain a valuable substance. Although this technology is a promising technology which can achieve carbon neutrality, economic efficiency is the biggest issue. In order to improve economic efficiency, it is important to enhance energy efficiency in capturing and reducing carbon dioxide and reduce a loss of carbon dioxide.

As a technology for capturing carbon dioxide, a technology is known in which carbon dioxide in a gas is physically or chemically adsorbed on a solid or liquid adsorbent, is thereafter desorbed by energy such as heat and is utilized. As the technology for electrochemically reducing carbon dioxide, a technology including using a cathode where a catalyst layer is formed using a carbon dioxide reduction catalyst on the side of a gas diffusion layer to be in contact with an electrolytic solution is used is known: in the technology, carbon dioxide gas is supplied to the cathode from the side opposite to the catalyst layer of the gas diffusion layer and carbon dioxide is electrochemically reduced (see for example, Patent Document 1).

Patent Document 1: PCT International Publication No. WO2018/232515

SUMMARY OF THE INVENTION

However, conventionally, a technology for capturing carbon dioxide and a technology for electrochemically reducing carbon dioxide have been researched and developed separately. Hence, although the overall energy efficiency when these technologies are combined and a carbon dioxide loss reduction effect can be multiplicatively determined from the efficiencies of the technologies, there is room for further improvement. It can be said that it is meaningful to enhance the energy efficiency and the carbon dioxide loss reduction effect from a comprehensive point of view in which the technology for capturing carbon dioxide and the technology for electrochemically reducing carbon dioxide are combined as described above.

In particular, in the technology for electrochemically reducing carbon dioxide, in reduction reactions which proceed on the side of a cathode, by-products are generated in addition to carbon compounds such as desired ethylene. Specifically, by-products such as methanol, ethanol, acetic acid and formic acid are generated, and these by-products are dissolved in an electrolytic solution and are difficult to separate. Hence, a loss of carbon dioxide occurs, and thus it is desirable to reduce the loss.

The present invention is made in view of the foregoing, and an object of the present invention is to provide a technology which can reduce a loss of carbon dioxide more than before in a carbon dioxide treatment apparatus which captures and electrochemically reduces carbon dioxide.

(1) The present invention provides a carbon dioxide treatment apparatus (for example, a carbon dioxide treatment apparatus 100 which will be described later) including: a capturing device (for example, a capturing device 1 which will be described later) that captures carbon dioxide; and an electrochemical reaction device (for example, an electrochemical reaction unit 2 which will be described later) that electrochemically reduces the carbon dioxide captured by the capturing device. The electrochemical reaction device includes: a cathode (for example, a cathode 21 which will be described later); an anode (for example, an anode 22 which will be described later); an electrolyte membrane (for example, an anion exchange membrane 23 which will be described later) that is provided between the cathode and the anode; a cathode-side liquid flow path (for example, a cathode-side liquid flow path 24*a* which will be described later) which is provided adjacent to the cathode and through which an electrolytic solution flows; an anode-side liquid flow path (for example, an anode-side liquid flow path 26*a* which will be described later) which is provided adjacent to the anode and through which the electrolytic solution flows; and a first liquid supply path (for example, a first liquid supply path 20 which will be described later) that supplies, to the anode-side liquid flow path, the electrolytic solution which has flowed through the cathode-side liquid flow path.

In the carbon dioxide treatment apparatus of (1), the electrolytic solution which flows out from the cathode-side liquid flow path via the first liquid supply path and includes by-products such as methanol, ethanol, acetic acid and formic acid can be supplied into the anode-side liquid flow path. In this way, the by-products such as methanol, ethanol, acetic acid and formic acid are oxidized by oxidation reactions which proceed in the anode, and thus carbon dioxide can be captured and recycled in the form of carbon dioxide ($CO_3^{2-}$) and electrons (e). Hence, in the carbon dioxide treatment apparatus of (1), it is possible to reduce a loss of carbon dioxide and enhance energy efficiency.

(2) In the carbon dioxide treatment apparatus of (1), the capturing device may include a carbon dioxide absorption unit (for example, a $CO_2$ absorption unit 12 which will be described later) that dissolves carbon dioxide in a strong alkaline electrolytic solution to absorb the carbon dioxide, and the carbon dioxide that has been dissolved in the electrolytic solution by the carbon dioxide absorption unit may be supplied to the electrochemical reaction device.

(3) The carbon dioxide treatment apparatus of (1) or (2) may further include: an electric energy storage device (for example, an electric energy storage device 3 which will be described later) that supplies electric energy to the electrochemical reaction device. The electric energy storage device may include: a conversion unit (for example, a conversion unit 31 which will be described later) that converts renewable energy into electric energy; and an electric energy storage unit (for example, an electric energy storage unit 32 which will be described later) that stores the electric energy converted by the conversion unit and includes a nickel-hydride battery, and the electrochemical reaction device may further include: a second liquid supply path (for example, a second liquid supply path 65 which will be described later) that supplies, to the nickel-hydride battery, the electrolytic solution which has flowed through the anode-side liquid flow path.

(4) The carbon dioxide treatment apparatus of any one of (1) to (3) may further include: a homologation reaction device (for example, a homologation reaction device 4 which will be described later) that increases the number of carbon atoms by multimerizing ethylene generated by reduction of the carbon dioxide in the electrochemical reaction device.

(5) The present invention also provides a carbon dioxide treatment method of electrochemically reducing carbon dioxide. In this method, carbon dioxide is treated while an electrolytic solution that has flowed through a cathode-side liquid flow path (for example, a cathode-side liquid flow path 24*a* which will be described later) provided adjacent to a cathode (for example, a cathode 21 which will be described later) is being supplied to an anode-side liquid flow path (for example, an anode-side liquid flow path 26*a* which will be described later) provided adjacent to an anode (for example, an anode 22 which will be described later).

(6) The present invention also provides a method of producing a carbon compound. In this method, and a carbon compound is produced by reducing carbon dioxide with the carbon dioxide treatment method of (5).

According to the present invention, it is possible to reduce a loss of carbon dioxide more than before in a carbon dioxide treatment apparatus which captures and electrochemically reduces carbon dioxide.

DETAILED DESCRIPTION OF THE INVENTION

Embodiments of the present invention will be described in detail below with reference to drawings.

[Carbon Dioxide Treatment Apparatus]

Figure 1:
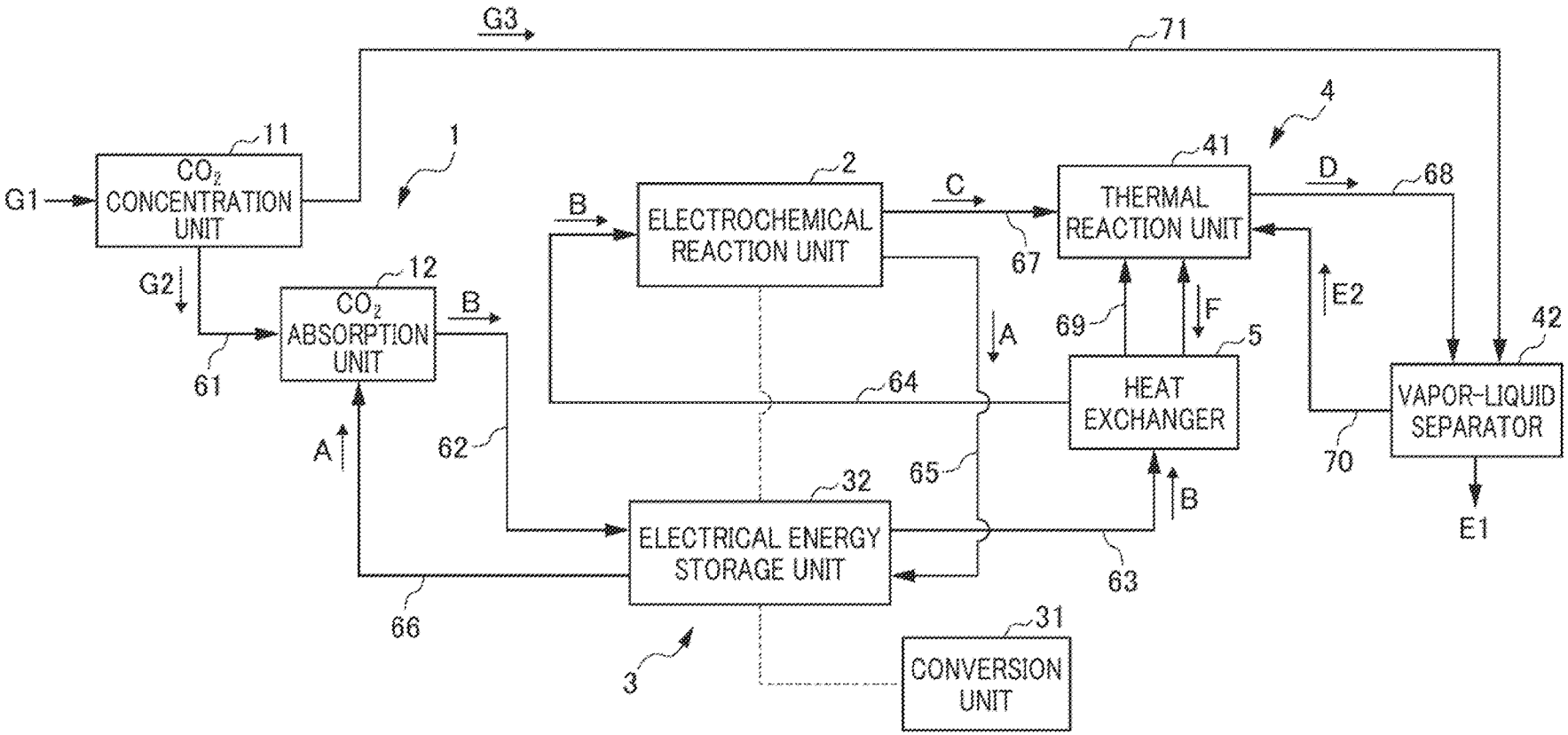
FIG. 1 is a block diagram showing a carbon dioxide treatment apparatus according to an embodiment of the present invention.

FIG. 1 is a block diagram showing a carbon dioxide treatment apparatus 100 according to an embodiment of the present invention. As shown in FIG. 1, the carbon dioxide treatment apparatus 100 according to the present embodiment includes a capturing device 1, an electrochemical reaction unit 2, an electric energy storage device 3, a homologation reaction device 4 and a heat exchanger 5. The capturing device 1 includes a $CO_2$ concentration unit 11 and a $CO_2$ absorption unit 12. The electrochemical reaction unit 2 includes an electrolytic cell. The electric energy storage device 3 includes a conversion unit 31 and an electric energy storage unit 32. The homologation reaction device 4 includes a heat reaction unit 41 and a gas-liquid separator 42.

In the carbon dioxide treatment apparatus 100, the $CO_2$ concentration unit 11 and the $CO_2$ absorption unit 12 are connected with a gas flow path 61. The CO absorption unit 12 and the electric energy storage unit 32 are connected with a liquid flow path 62 and a liquid flow path 66. The electric energy storage unit 32 and the heat exchanger 5 are connected with a liquid flow path 63. The heat exchanger 5 and the electrochemical reaction unit 2 are connected with a liquid flow path 64. The electrochemical reaction unit 2 and the electric energy storage unit 32 are connected with a second liquid supply path 65 which is a liquid flow path. The electrochemical reaction unit 2 and the heat reaction unit 41 are connected with a gas flow path 67. The heat reaction unit 41 and the gas-liquid separator 42 are connected with a gas flow path 66 and a gas flow path 70. Between the heat reaction unit 41 and the heat exchanger 5, a circulation flow path 69 for a heat medium is provided. The $CO_2$ concentration unit 11 and the gas-liquid separator 42 are connected with a gas flow path 71.

The flow paths described above are not particularly limited, and known pipes and the like can be used as necessary. In the gas flow paths 61, 67, 68, 70 and 71, an air supply unit such as a compressor, a valve, a measuring device such as a flowmeter and the like can be provided as necessary. In the liquid flow paths 62 to 66, a liquid supply unit such as a pump, a valve, a measuring device such as a flowmeter and the like can be provided as necessary.

The capturing device 1 captures carbon dioxide. A gas G1 containing carbon dioxide such as air or an exhaust gas is supplied to the $CO_2$ concentration unit 11. The $CO_2$ concentration unit 11 concentrates carbon dioxide in the gas G1. As the $CO_2$ concentration unit 11, a known concentration device can be adopted as long as it can concentrate carbon dioxide, and for example, a membrane separation device which utilizes differences in permeation rate to a membrane and an adsorption separation device which utilizes chemical or physical adsorption and desorption can be utilized. In terms of excellent separation performance, in particular, chemical adsorption which utilizes temperature swing adsorption is preferable.

A concentrated gas G2 obtained by concentrating carbon diozide in the $CO_2$ concentration unit 11 is supplied via the gas flow path 61 to the $CO_2$ absorption unit 12. A separation gas G3 which is separated from the concentrated gas G2 is supplied via the gas flow path 71 to the gas-liquid separator 42.

In the $CO_2$ absorption unit 12, carbon dioxide gas in the concentrated gas G2 supplied from the $CO_2$ concentration unit 11 makes contact with an electrolytic solution A, and thus carbon dioxide is dissolved in the electrolytic solution A to be absorbed. A method of bringing the carbon dioxide gas into contact with the electrolytic solution A is not particularly limited, and examples thereof include a method of blowing the concentrated gas G2 into the electrolytic solution A to perform bubbling.

In the $CO_2$ absorption unit 12, as an absorption solution that absorbs carbon dioxide, the electrolytic solution A which includes a strong alkaline aqueous solution is used. In carbon dioxide, the carbon atom is positively charged ($\delta+$) because the oxygen atoms strongly attract electrons. Hence, in the strong alkaline aqueous solution in which a large number of hydroxide ions are present, carbon dioxide easily undergoes a dissolution reaction from a hydrated state to $CO_3^{2-}$ via $HCO_3^-$ so as to reach an equilibrium state with a high abundance of $CO_3^{2-}$. Thus, as compared with other gases such as nitrogen, hydrogen and oxygen, carbon dioxide is easily dissolved in the strong alkaline aqueous solution, and in the $CO_2$ absorption unit 12, carbon dioxide in the concentrated gas G2 is selectively absorbed by the electrolytic solution A. As described above, the electrolytic solution A is used in the $CO_2$ absorption unit 12, and thus the concentration of carbon dioxide can be promoted. Therefore, in the $CO_2$ concentration unit 11, carbon dioxide does not need to be concentrated so as to have a high concentration, with the result that it is possible to reduce energy necessary for the concentration.

An electrolytic solution B in which carbon dioxide is absorbed in the $CO_2$ absorption unit 12 is sent to the electrochemical reaction unit 2 via the liquid flow path 62, the electric energy storage unit 32, the liquid flow path 63, the heat exchanger 5 and the liquid flow path 64. The electrolytic solution A which flows out from the electrochemical reaction unit 2 is sent to the $CO_2$ absorption unit 12 via the second liquid supply path 65, the electric energy storage unit 32 and the liquid flow path 66. As described above, in the carbon dioxide treatment apparatus 100, the electrolytic solution is circulated between the CO absorption unit 12, the electric energy storage unit 32 and the electrochemical reaction unit 2.

Examples of the strong alkaline aqueous solution used in the electrolytic solution A include a potassium hydroxide aqueous solution and a sodium hydroxide aqueous solution. Among them, the potassium hydroxide aqueous solution is preferably used in terms of excellent solubility of carbon dioxide in the $CO_2$ absorption unit 12 and promotion of the reduction of carbon dioxide in the electrochemical reaction unit 2.

Figure 2:
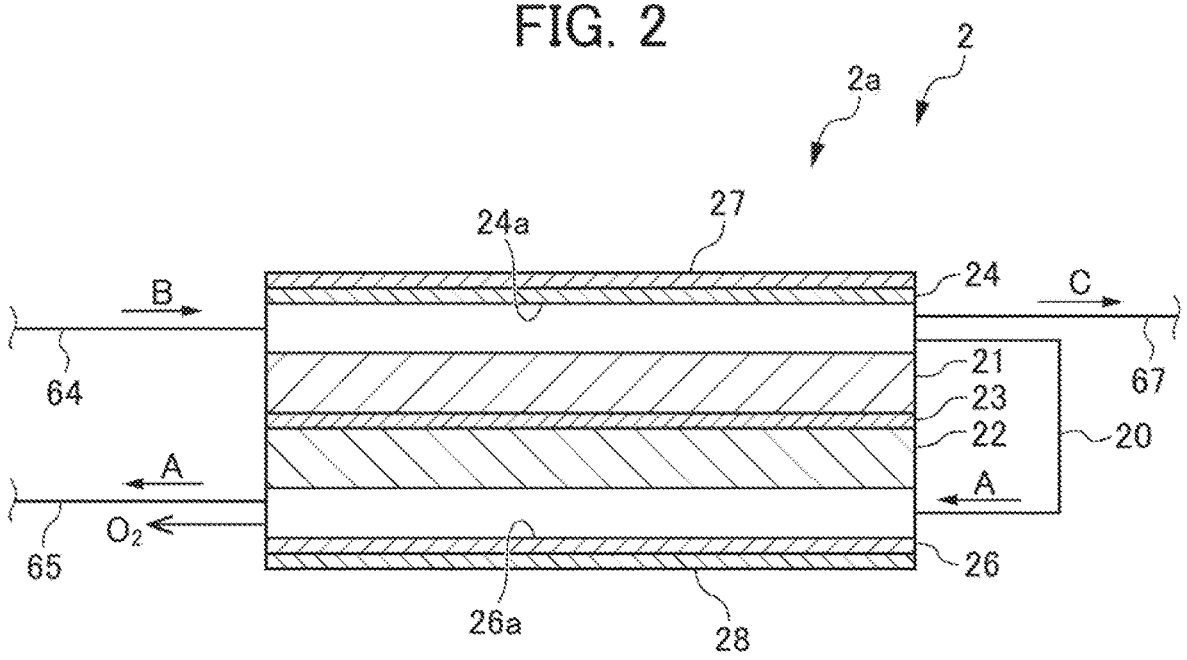
FIG. 2 is a schematic cross-sectional view showing an example of an electrolytic cell in an electrochemical reaction unit.

FIG. 2 is a schematic cross-sectional view showing an example of the electrolytic cell 2*a* in the electrochemical reaction unit 2. The electrochemical reaction unit 2 uses the electrolytic cell 2*a* to electrochemically reduce carbon dioxide. As shown in FIG. 2, the electrolytic cell 2*a* of the electrochemical reaction unit 2 includes a cathode 21, an anode 22, an anion exchange membrane 23, a cathode-side liquid flow path structure 24 which forms a cathode-side liquid flow path 24*a*, an anode-side liquid flow path structure 26 which forms an anode-side liquid flow path 26*a*, a feed conductor 27 and a feed conductor 28. Although FIG. 2 shows one electrolytic cell 2*a*, the electrochemical reaction unit 2 preferably includes an electrolytic cell stack which is formed by stacking a plurality of electrolytic cells 2*a*.

In the electrolytic cell 2*a* of the electrochemical reaction unit 2, the feed conductor 27, the cathode-side liquid flow path structure 24, the cathode 21, the anion exchange membrane 23, the anode 22, the anode-side liquid flow path structure 26 and the feed conductor 28 are stacked in this order. Between the cathode 21 and the cathode-side liquid flow path structure 24, the cathode-side liquid flow path 24*a* is formed, and between the anode 22 and the anode-side liquid flow path structure 26, the anode-side liquid flow path 26*a* is formed. The cathode-side liquid flow path 24*a* and the anode-side liquid flow path 26*a* are provided in positions opposite each other sandwiching the cathode 21, the anion exchange membrane 23 and the anode 22. A plurality of cathode-side liquid flow paths 24*a* and a plurality of anode-side liquid flow path 26*a* are preferably provided, and the shapes thereof may be linear or zigzag.

The feed conductors 27 and 28 are electrically connected to the electric energy storage unit 32 in the electric energy storage device 3. The cathode-side liquid flow path structure 24 and the anode-side liquid flow path structure 26 each are conductors, and thus a voltage can be applied between the cathode 21 and the anode 22 by power supplied from the electric energy storage unit 32.

The cathode 21 is an electrode which reduces carbon dioxide to generate a carbon compound and reduces water to generate hydrogen. Examples of the cathode 21 include an electrode which includes a gas diffusion layer and a cathode catalyst layer formed on the surface of the gas diffusion layer on the side of the cathode-side liquid flow path 24*a*. The cathode catalyst layer may be arranged such that a part thereof enters the gas diffusion layer. Between the gas diffusion layer and the cathode catalyst layer, a porous layer which is denser than the gas diffusion layer may be arranged.

As a cathode catalyst which forms the cathode catalyst layer, a known catalyst for promoting the reduction of carbon dioxide can be used. Specific examples of the cathode catalyst include: metals such as gold, silver, copper, platinum, palladium, nickel, cobalt, iron, manganese, titanium, cadmium, zinc, indium, gallium, lead and tin; alloys and intermetallic compounds thereof; and metal complexes such as a ruthenium complex and a rhenium complex. Among them, in terms of promoting the reduction of carbon dioxide, copper and silver are preferable, and copper is more preferably used. One type of cathode catalyst may be used singly or two or more types may be used together. As the cathode catalyst, a supported catalyst may be used in which metal particles are supported on a carbon material (such as carbon particles, a carbon nanotube or graphene).

The gas diffusion layer of the cathode 21 is not particularly limited, and examples thereof include carbon paper and carbon cloth. A method of producing the cathode 21 is not particularly limited, and examples thereof include a method of applying slurry of a liquid composition containing the cathode catalyst to the surface of the gas diffusion layer on the side of the cathode-side liquid flow path 24*a* and drying the slurry.

The anode 22 is an electrode which oxidizes hydroxide ions to generate oxygen. Examples of the anode 22 include an electrode which includes a gas diffusion layer and an anode catalyst layer formed on the surface of the gas diffusion layer on the side of the anode-side liquid flow path 26*a*. The anode catalyst layer may be arranged such that a part thereof enters the gas diffusion layer. Between the gas diffusion layer and the anode catalyst layer, a porous layer which is denser than the gas diffusion layer may be arranged.

An anode catalyst which forms the anode catalyst layer is not particularly limited, and a known anode catalyst can be used. Specific examples thereof include: metals such as platinum, palladium and nickel; alloys and intermetallic compounds thereof; metal oxides such as manganese oxide, iridium oxide, nickel oxide, cobalt oxide, iron oxide, tin oxide, indium oxide, ruthenium oxide, lithium oxide and lanthanum oxide; and metal complexes such as a ruthenium complex and a rhenium complex. One type of anode catalyst may be used singly or two or more types may be used together.

Examples of the gas diffusion layer of the anode 22 include carbon paper and carbon cloth. As the gas diffusion layer, a porous body such as a mesh material, a punching material, a porous material or a sintered metal fiber may be used. Examples of the material of the porous body include: metals such as titanium, nickel and iron; and alloys thereof (for example, SUS).

Examples of the material of the cathode-side liquid flow path structure 24 and the anode-side liquid flow path structure 26 include metals such as titanium and SUS and carbon.

Examples of the material of the feed conductors 27 and 28 include metals such as copper, gold titanium and SUS and carbon. As the feed conductors 27 and 28, a material obtained by performing plating treatment such as gold plating on the surface of a copper base material may be used.

The electrolytic cell 2*a* of the electrochemical reaction unit 2 is a flow cell in which the electrolytic solution B supplied from the $CO_2$ absorption unit 12 and sent via the electric energy storage unit 32 and the heat exchanger 5 flows into the cathode-side liquid flow path 24*a*. Then, a voltage is applied to the cathode 21 and the anode 22, and thus the dissolved carbon dioxide in the electrolytic solution B flowing through the cathode-side liquid flow path 24*a* is electrochemically reduced in the cathode 21, with the result that a carbon compound and hydrogen are generated. The electrolytic solution B at the inlet of the cathode-side liquid flow path 24*a* is in a weak alkaline state with a high abundance of $CO_3^{2-}$ because carbon dioxide is dissolved therein. On the other hand, as the electrolytic solution flows through the cathode-side liquid flow path 24*a* and the reduction proceeds, the amount of dissolved carbon dioxide, that is, the amount of $CO_3^{2-}$ in the electrolytic solution is lowered, with the result that the electrolytic solution is changed into the electrolytic solution A in a strong alkaline state at the outlet of the cathode-side liquid flow path 24*a*.

Examples of the carbon compound generated by reducing carbon dioxide in the cathode 21 include carbon monoxide, ethylene and the like. For example, the following reactions proceed, and thus carbon monoxide and ethylene are generated as gaseous products. In the cathode 21, hydrogen is also generated by the following reaction. The gaseous carbon compound and hydrogen generated flow out from the outlet of the cathode-side liquid flow path 24*a*.

$$CO_2+H_2O \rightarrow CO+2OH^-$$

$$2CO+8H_2O \rightarrow C_2H_4+8OH^-+2H_2O$$

$$2H_2O \rightarrow H_2+2OH^-$$

The hydroxide ions generated in the cathode 21 permeate the anion exchange membrane 23 to move to the anode 22, and are oxidized by the following reaction, with the result that oxygen is generated. The generated oxygen permeates the gas diffusion layer of the anode 22, flows into the anode-side liquid flow path 26*a* and flows out from the outlet of the anode-side liquid flow path 26*a*.

$$4OH^- \rightarrow O_2+2H_2O$$

As described above, in the carbon dioxide treatment apparatus 100, the electrolytic solution used in the electrochemical reaction unit 2 is also used as the absorption solution for the $CO_2$ absorption unit 12, and carbon dioxide is supplied to the electrochemical reaction unit 2 while being dissolved in the electrolytic solution B and is electrochemically reduced. In this way, for example, as compared with a case where carbon dioxide is adsorbed on an adsorbent and is desorbed by heating so as to be reduced, energy necessary for desorption of carbon dioxide is reduced, with the result that energy efficiency can be increased.

Here, in the reduction reactions of carbon dioxide which proceeds in the cathode 21, by-products are generated in addition to carbon compounds such as desired ethylene. Specifically, by-products such as methanol, ethanol, acetic acid and formic acid are generated, and these by-products are dissolved in the electrolytic solution and are difficult to separate. Hence, a loss of carbon dioxide occurs, and thus it is desirable to reduce the loss.

Specifically, in the cathode 21, the reduction reactions of carbon dioxide as described below proceed, and thus methanol, ethanol, acetic acid and formic acid are generated. Hence, the electrolytic solution A which has flowed through the cathode-side liquid flow path 24*a* includes the by-products such as methanol, ethanol, acetic acid and formic acid.

$$2CO_3^{2-}+12H_2O+12e^- \rightarrow 2CH_3OH+16OH^-$$

$$2CO_3^{2-}+11H_2O+12e^- \rightarrow C_2H_5OH+16OH^-$$

$$2CO_3^{2-}+8H_2O+8e^- \rightarrow CH_3COOH+12OH^-$$

$$2CO_3^{2-}+6H_2O+4e^- \rightarrow 2HCOOH+8OH^-$$

By contrast, the electrolytic cell 2*a* of the electrochemical reaction unit 2 in the present embodiment includes a first liquid supply path 20 which supplies, to the anode-side liquid flow path 26*a*, the electrolytic solution A which has flowed through the cathode-side liquid flow path 24*a*. The first liquid supply path 20 supplies, from the inlet of the anode-side liquid flow path 26*a* into the anode-side liquid flow path 26*a*, the electrolytic solution A which flows out from the outlet of the cathode-side liquid flow path 24*a* and includes the by-products such as methanol, ethanol, acetic acid and formic acid. As shown in FIG. 2, the electrolytic solution flowing through the anode-side liquid flow path 26*a* consists only of the electrolytic solution A that has passed through the cathode-side liquid flow path 24*a* and been supplied via the first liquid supply path 20. In other words, the anode-side liquid flow path 26*a* does not receive any electrolytic solution that has not passed through the cathode-side liquid flow path 24*a*. In this way, the by-products such as methanol, ethanol, acetic acid and formic acid are oxidized by oxidation reactions which proceed in the anode 22, and thus carbon dioxide is captured in the form of carbon dioxide (CO32-) and electrons (e-).

Specifically, in the anode 22, the oxidation reactions of the by-products such as methanol, ethanol, acetic acid and formic acid as described below proceed, and thus these by-products are converted into the form of carbon dioxide ($CO_3^{2-}$) and electrons ($e^-$). The electrolytic solution A which flows through the anode-side liquid flow path 26*a* and in which the by-products are converted into the form of carbon dioxide ($CO_3^{2-}$) and electrons ($e^-$) is supplied by the second liquid supply path 65 to a nickel-hydride battery which forms the electric energy storage unit 32 to be described later. As described above, in the electrolytic cell 2*a* of the electrochemical reaction unit 2 in the present embodiment, carbon dioxide can be captured and recycled, and thus it is possible to reduce a loss of carbon dioxide and enhance energy efficiency.

$$2CH_3OH+16OH^- \rightarrow 2CO_3^{2-}+12H_2O+12e^-$$

$$C_2H_5OH+16OH^- \rightarrow 2CO_3^{2-}+11H_2O+12e^-$$

$$CH_3COOH+12OH^- \rightarrow 2CO_3^{2-}+8H_2O+8e^-$$

$$2HCOOH+8OH^- \rightarrow 2CO_3^{2-}+6H_2O+4e^-$$

With reference back to FIG. 1, the electric energy storage device 3 is a device which supplies power to the electrochemical reaction unit 2. In the conversion unit 31, renewable energy is converted into electric energy. The conversion unit 31 is not particularly limited, and examples thereof include a wind power generator, a solar power generator, a geothermal power generator and the like. One or a plurality of conversion units 31 may be included in the electric energy storage device 3.

The electric energy storage unit 32 is electrically connected to the conversion unit 31. In the electric energy storage unit 32, the electric energy converted by the conversion unit 31 is stored. The converted electric energy is stored in the electric energy storage unit 32, and thus it is possible to stably supply power to the electrochemical reaction unit 2 even when the conversion unit 31 does not generate power. When renewable energy is utilized, though in general, large voltage fluctuations easily occur, the electric energy is temporarily stored in the electric energy storage unit 32, and thus it is possible to stably supply power to the electrochemical reaction unit 2.

The electric energy storage unit 32 in the present embodiment includes a nickel-hydride battery. However, as long as the electric energy storage unit 32 can perform charging and discharging, the electric energy storage unit 32 may include, for example, a lithium-ion secondary battery or the like.

Figure 3A:
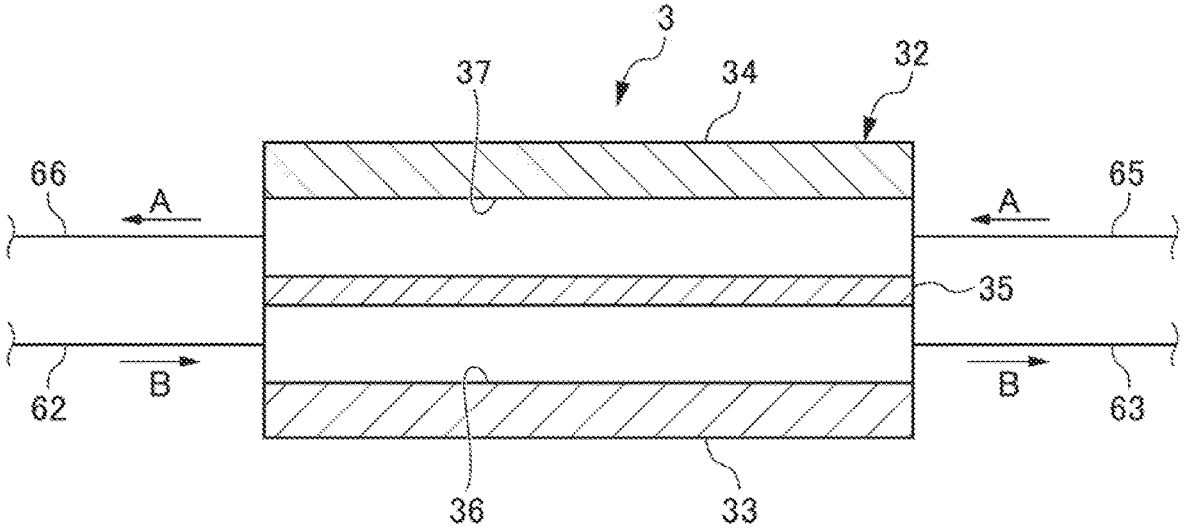
FIG. 3A is a diagram showing a nickel-hydride battery in an electric energy storage unit during discharge.
Figure 3B:
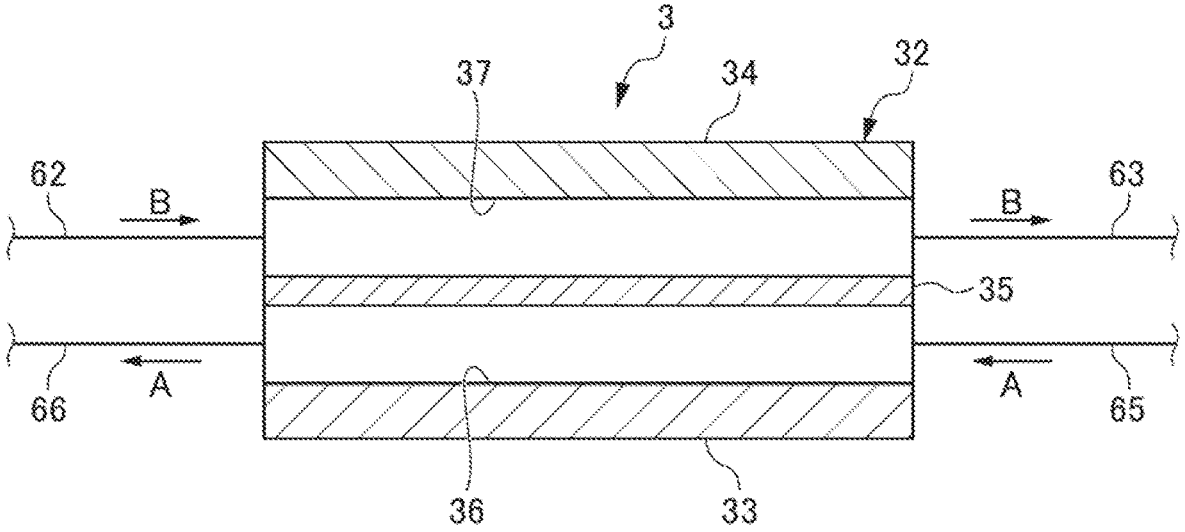
FIG. 3B is a diagram showing the nickel-hydride battery in the electric energy storage unit during charge.

Here, FIG. 3A is a diagram showing the nickel-hydride battery in the electric energy storage unit 32 during discharge. FIG. 3B is a diagram showing the nickel-hydride battery in the electric energy storage unit 32 during charge. As shown in FIGS. 3A and 3B, the electric energy storage unit 32 is the nickel-hydride battery which includes a positive electrode 33, a negative electrode 34, a separator 35 provided between the positive electrode 33 and the negative electrode 34, a positive electrode side flow path 36 formed between the positive electrode 33 and the separator 35 and a negative electrode side flow path 37 formed between the negative electrode 34 and the separator 35. The positive electrode side flow path 36 and the negative electrode side flow path 37 can be formed using, for example, the same liquid flow path structures as the cathode-side liquid flow path 24*a* and the anode-side liquid flow path 26*a* in the electrochemical reaction unit 2.

Examples of the positive electrode 33 include a positive electrode in which a positive electrode active material is applied to the surface of a positive electrode current collector on the side of the positive electrode side flow path 36. The positive electrode current collector is not particularly limited, and examples thereof include nickel foil and nickel plated metal foil. The positive electrode active material is not particularly limited, and examples thereof include nickel hydroxide and nickel oxyhydroxide.

Examples of the negative electrode 34 include a negative electrode in which a negative electrode active material is applied to the surface of a negative electrode current collector on the side of the negative electrode side flow path 37. The negative electrode current collector is not particularly limited, and examples thereof include nickel mesh. The negative electrode active material is not particularly limited, and examples thereof include a known hydrogen storage alloy.

The separator 35 is not particularly limited, and examples thereof include an ion exchange membrane.

The nickel-hydride battery of the electric energy storage unit 32 is a flow cell in which the electrolytic solution flows through each of the positive electrode side flow path 36 on the side of the positive electrode 33 with respect to the separator 35 and the negative electrode side flow path 37 on the side of the negative electrode 34 with respect to the separator 35. In the carbon dioxide treatment apparatus 100 of the present embodiment, the electrolytic solution B supplied from the $CO_2$ absorption unit 12 via the liquid flow path 62 and the electrolytic solution A supplied from the electrochemical reaction unit 2 via the second liquid supply path 65 are respectively supplied to the positive electrode side flow path 36 and the negative electrode side flow path 37.

Each of the connections of the liquid flow path 62 and the liquid flow path 63 to the electric energy storage unit 32 is switched by, for example, a switching valve between a state where the liquid flow path is connected to the positive electrode side flow path 36 and a state where the liquid flow path is connected to the negative electrode side flow path 37. Likewise, each of the connections of the second liquid supply path 65 and the liquid flow path 66 to the electric energy storage unit 32 is switched by, for example, a switching valve between a state where the path is connected to the positive electrode side flow path 36 and a state where the path is connected to the negative electrode side flow path 37.

When the nickel-hydride battery is discharged, hydroxide ions are generated from water molecules in the positive electrode 33, the hydroxide ions which have moved to the negative electrode 34 receive hydrogen ions from a hydrogen storage alloy to generate water molecules. Hence, in terms of discharge efficiency, the electrolytic solution flowing through the positive electrode side flow path 36 is advantageous to be in a weak alkaline state, and the electrolytic solution flowing through the negative electrode side flow path 37 is advantageous to be in a strong alkaline state. Hence, preferably, during discharge, as shown in FIG. 3A, the liquid flow paths 62 and 63 are connected to the positive electrode side flow path 36, the second liquid supply path 65 and the liquid flow path 66 are connected to the negative electrode side flow path 37 such that the electrolytic solution B in a weak alkaline state supplied from the $CO_2$ absorption unit 12 flows through the positive electrode side flow path 36 and the electrolytic solution A in a strong alkaline state supplied from the electrochemical reaction unit 2 flows through the negative electrode side flow path 37. In other words, preferably, during discharge, the electrolytic solution is circulated from the $CO_2$ absorption unit 12, to the positive electrode side flow path 36 of the electric energy storage unit 32, to the electrochemical reaction unit 2, to the negative electrode side flow path 37 of the electric energy storage unit 32 and back to the $CO_2$ absorption unit 12.

When the nickel-hydride battery is charged, water molecules are generated from hydroxide ions in the positive electrode 33, the water molecules are decomposed into hydrogen atoms and hydroxide ions in the negative electrode 34 and the hydrogen atoms are stored in the hydrogen storage alloy. Hence, in terms of charge efficiency, the electrolytic solution flowing through the positive electrode side flow path 36 is advantageous to be in a strong alkaline state, and the electrolytic solution flowing through the negative electrode side flow path 37 is advantageous to be in a weak alkaline state. Hence, preferably, during charge, as shown in FIG. 3B, the liquid flow paths 62 and 63 are connected to the negative electrode side flow path 37, the second liquid supply path 65 and the liquid flow path 66 are connected to the positive electrode side flow path 36 such that the electrolytic solution B in a weak alkaline state supplied from the $CO_2$ absorption unit 12 flows through the negative electrode side flow path 37 and the electrolytic solution A in a strong alkaline state supplied from the electrochemical reaction unit 2 flows through the positive electrode side flow path 36. In other words, preferably, during charge, the electrolytic solution is circulated from the $CO_2$ absorption unit 12, to the negative electrode side flow path 37 of the electric energy storage unit 32, to the electrochemical reaction unit 2, to the positive electrode side flow path 36 of the electric energy storage unit 32 and back to the $CO_2$ absorption unit 12.

In general, when a secondary battery is assembled into a device, the overall energy efficiency tends to be lowered only by charge and discharge efficiency. However, in the present embodiment, as described above, the pH gradient of the electrolytic solution A and the electrolytic solution B in front of and behind the electrochemical reaction unit 2 is utilized, and thus the electrolytic solutions flowing through the positive electrode side flow path 36 and the negative electrode side flow path 37 in the electric energy storage unit 32 are appropriately switched, with the result that charge and discharge efficiency corresponding to the "concentration overvoltage" of an electrode reaction represented by the Nernst equation can be improved.

With reference back to FIG. 1, the homologation reaction device 4 is a device which increases the number of carbon atoms by multimerizing ethylene generated by reduction of carbon dioxide in the electrochemical reaction unit 2. Ethylene gas C generated by reduction in the cathode 21 of the electrochemical reaction unit 2 is sent to the heat reaction unit 41 via the gas flow path 67. In the heat reaction unit 41, a multimerization reaction of ethylene is performed in the presence of an olefin multimerization catalyst. In this way, for example, an olefin having the number of carbon atoms increased such as 1-butene, 1-hexene or 1-octene can be produced.

The olefin multimerization catalyst is not particularly limited, a known catalyst used in the multimerization reaction can be used and examples thereof include a solid acid catalyst using silica alumina or zeolite as a carrier and a transition metal complex compound.

In the homologation reaction device 4 of the present embodiment, a generated gas D after the multimerization reaction flowing out from the heat reaction unit 41 is sent to the gas-liquid separator 42 through the gas flow path 68. An olefin having 6 or more carbon atoms is liquid at room temperature. Therefore, for example, when an olefin having 6 or more carbon atoms is a desired carbon compound, if the temperature of the gas-liquid separator 42 is set to about 30° C., an olefin having 6 or more carbon atoms (an olefin liquid E1) and an olefin having less than 6 carbon atoms (an olefin gas E2) can be easily gas-liquid separated. In addition, if the temperature of the gas-liquid separator 42 is raised, the number of carbon atoms of the obtained the olefin liquid E1 can be increased.

When the gas G1 supplied to the $CO_2$ concentration unit 11 of the capturing device 1 is air, the separation gas G3 sent from the $CO_2$ concentration unit 11 through the gas flow path 71 may be used to cool the generated gas D in the gas-liquid separator 42. For example, using the gas-liquid separator 42 including a cooling pipe, the separation gas G3 is passed into the cooling pipe, and the generated gas D is passed outside the cooling pipe and aggregated on the surface of the cooling pipe to form the olefin liquid E1. In addition, the olefin gas E2 separated by the gas-liquid separator 42 contains an unreacted component such as ethylene and an olefin having a smaller number of carbon atoms than a desired olefin, and thus the olefin gas E2 can be returned to the heat reaction unit 41 through the gas flow path 70 and re-used in the multimerization reaction.

The multimerization reaction of ethylene in the heat reaction unit 41 is an exothermic reaction in which a supply material has a higher enthalpy than a product material and the reaction enthalpy is negative. In the carbon dioxide treatment apparatus 100, reaction heat generated in the heat reaction unit 41 of the homologation reaction device 4 is utilized to heat a heat medium F, the heat medium F is circulated through the circulation flow path 69 into the heat exchanger 5 and in the heat exchanger 5, heat is exchanged between the heat medium F and the electrolytic solution B. In this way, the electrolytic solution B which is supplied to the electrochemical reaction unit 2 is heated. In the electrolytic solution B using a strong alkaline aqueous solution, even when the temperature thereof is increased, the dissolved carbon dioxide is unlikely to be separated as a gas, and the temperature of the electrolytic solution B is increased to enhance the reaction rate of oxidation-reduction in the electrochemical reaction unit 2.

The homologation reaction device 4 may further include a reaction unit in which a hydrogenation reaction of an olefin obtained by multimerizing ethylene is performed using hydrogen generated in the electrochemical reaction unit 2 or a reaction unit in which an isomerization reaction of olefin and paraffin is performed.

[Carbon Dioxide Treatment Method]

A carbon dioxide treatment method according to an embodiment of the present invention is performed using, for example, the carbon dioxide treatment apparatus 100 described above. Specifically, the carbon dioxide treatment method of the present embodiment preferably includes: a step (a) of bringing carbon dioxide gas into contact with the electrolytic solution of a strong alkaline aqueous solution, dissolving carbon dioxide in the electrolytic solution and absorbing it; and a step (b) of electrochemically reducing the dissolved carbon dioxide in the electrolytic solution to generate a carbon compound and hydrogen. The carbon dioxide treatment method of the present embodiment can be utilized for a method of producing a carbon compound. Specifically, with the carbon dioxide treatment method of the present embodiment, it is possible to produce a carbon compound in which carbon dioxide is reduced and a carbon compound capable of being obtained by using, as a raw material, a carbon compound in which carbon dioxide is reduced.

The carbon dioxide treatment method of the present embodiment is characterized in that in the electrochemical reduction of carbon dioxide as in the step (b) described above, an electrolytic solution A which has flowed through a cathode-side liquid flow path 24*a* provided adjacent to a cathode 21 is supplied to an anode-side liquid flow path 26*a* provided adjacent to an anode 22. In this way, by-products such as methanol, ethanol, acetic acid and formic acid generated by reduction reactions in the cathode 21 are oxidized by oxidation reactions which proceed in the anode 22, and thus carbon dioxide can be captured and recycled in the form of carbon dioxide ($CO_3^{2-}$) and electrons ($e^-$), with the result that it is possible to reduce a loss of carbon dioxide and enhance energy efficiency.

As in a case where the carbon dioxide treatment apparatus 100 as described above including the homologation reaction device 4 is used, the carbon dioxide treatment method of the present embodiment preferably further includes, in addition to the steps (a) and (b), a step (c) of multimerizing ethylene which is generated by reducing the dissolved carbon dioxide.

The present disclosure is not limited to the embodiments described above, and as long as the object of the present disclosure can be achieved, variations and modifications are included in the present disclosure.

Although in the embodiment described above, carbon dioxide is dissolved in the electrolytic solution and is supplied to the electrochemical reaction unit 2, the present disclosure is not limited to this configuration. Carbon dioxide gas may be supplied to the electrochemical reaction unit 2 without being treated.

For example, in the first liquid supply path 20 of the embodiment described above, a branch liquid flow path which is connected to the $CO_2$ absorption unit 12 via a switching valve such as a three-way valve may be provided. In this way, the switching valve is switched, and thus it is possible to directly supply the electrolytic solution A to the $CO_2$ absorption unit 12 via the branch liquid flow path.

Although the carbon dioxide treatment apparatus 100 of the embodiment described above includes the capturing device 1, the electric energy storage device 3, the homologation reaction device 4 and the heat exchanger 5, the present disclosure is not limited to this configuration, and all or a part thereof may be omitted.

EXPLANATION OF REFERENCE NUMERALS

1 capturing device
2 electrochemical reaction unit (electrochemical reaction device)
3 electric energy storage device
4 homologation reaction device
12 $CO_2$ absorption unit
20 first liquid supply path
21 cathode
22 anode
23 anion exchange membrane (electrolyte membrane)
24*a* cathode-side liquid flow path
26*a* anode-side liquid flow path
31 conversion unit
32 electric energy storage unit
65 second liquid supply path
100 carbon dioxide treatment apparatus

What is claimed is:

1. A carbon dioxide treatment apparatus comprising:
a capturing device that captures carbon dioxide; and
an electrochemical reaction device that electrochemically reduces the carbon dioxide captured by the capturing device,
the electrochemical reaction device including:
a cathode;
an anode;
an electrolyte membrane that is provided between the cathode and the anode;
a cathode-side liquid flow path which is provided adjacent to the cathode and through which an electrolytic solution flows;
an anode-side liquid now path which is provided adjacent to the anode and through which the electrolytic solution flows; and,
a first liquid supply path that supplies, to the anode-side liquid flow path, the electrolytic solution which has flowed through the cathode-side liquid flow path,
wherein the electrolytic solution flowing through the anode-side liquid flow path consists only of the electrolytic solution that has passed through the cathode-side liquid flow path and been supplied via the first liquid supply path.

2. The carbon dioxide treatment apparatus according to claim 1, wherein the capturing device includes a carbon dioxide absorption unit that dissolves carbon dioxide in an alkaline electrolytic solution to absorb the carbon dioxide, and
the carbon dioxide that has been dissolved in the electrolytic solution by the carbon dioxide absorption unit is supplied to the electrochemical reaction device.

3. The carbon dioxide treatment apparatus according to claim 1 further comprising: an electric energy storage device that supplies electric energy to the electrochemical reaction device,
wherein the electric energy storage device includes:
a conversion unit that converts renewable energy into electric energy; and
an electric energy storage unit that stores the electric energy converted by the conversion unit and includes a nickel-hydride battery, and
the electrochemical reaction device further includes:
a second liquid supply path that supplies, to the nickel-hydride battery, the electrolytic solution which has flowed through the anode-side liquid flow path.

4. The carbon dioxide treatment apparatus according to claim 1 further comprising: a homologation reaction device that increases a number of carbon atoms by multimerizing ethylene generated by reduction of the carbon dioxide in the electrochemical reaction device.

5. A carbon dioxide treatment method of electrochemically reducing carbon dioxide by using an electrochemical reaction device that includes a cathode, an anode, and an electrolyte membrane provided between the cathode and the anode,
wherein carbon dioxide is treated while an electrolytic solution that has passed through a cathode-side liquid flow path provided adjacent to the cathode is supplied to an anode-side liquid flow path provided adjacent to the anode,
wherein the electrolytic solution flowing through the anode-side liquid flow path consists only of the electrolytic solution that has passed through the cathode-side liquid flow path.

6. A method of producing a carbon compound, wherein a carbon compound is produced by reducing carbon dioxide with the carbon dioxide treatment method according to claim 5.

* * * * *